US007766322B2

(12) United States Patent
Nakamura et al.

(10) Patent No.: US 7,766,322 B2
(45) Date of Patent: Aug. 3, 2010

(54) SHEET TRANSFER DIRECTION CHANGING APPARATUS

(75) Inventors: Hideki Nakamura, Hachioji (JP); Eiji Sugimoto, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 175 days.

(21) Appl. No.: 11/397,138

(22) Filed: Apr. 3, 2006

(65) Prior Publication Data

US 2007/0001361 A1 Jan. 4, 2007

(30) Foreign Application Priority Data

Jun. 13, 2005 (JP) ..... 2005-172101

(51) Int. Cl.
*B65H 29/00* (2006.01)

(52) U.S. Cl. ..... 271/184; 271/185; 271/186

(58) Field of Classification Search ..... 271/184, 271/185, 187, 298, 299, 225, 186; 270/28.09, 270/28.14
See application file for complete search history.

(56) References Cited

U.S. PATENT DOCUMENTS 5,461,469 A * 10/1995 Farrell et al. ..... 399/407
5,810,352 A * 9/1998 Kobayashi et al. ..... 271/293
5,833,232 A * 11/1998 Ifkovits et al. ..... 271/225
5,931,462 A * 8/1999 Delfosse ..... 271/228
6,032,947 A * 3/2000 Parker ..... 271/213
6,260,837 B1 * 7/2001 Nanba et al. ..... 270/58.08
6,422,553 B1 * 7/2002 Asao ..... 270/58.11
6,511,063 B1 * 1/2003 Dickhoff et al. ..... 271/184
6,612,571 B2 * 9/2003 Rider ..... 271/279
6,616,135 B1 * 9/2003 Shida et al. ..... 270/58.08
6,689,040 B2 * 2/2004 Ifkovits et al. ..... 493/419
2005/0062222 A1 * 3/2005 Willis ..... 271/272
2005/0218587 A1 * 10/2005 Kasahara et al. ..... 271/279
2005/0230895 A1 * 10/2005 Kawatsu et al. ..... 270/52.17
2006/0071414 A1 * 4/2006 Kawatsu et al. ..... 271/225

FOREIGN PATENT DOCUMENTS

JP 64-39342 9/1987
JP 08-026533 1/1996
JP 2003-155160 5/2003
JP 2005-096913 4/2005

* cited by examiner

*Primary Examiner*—Patrick Mackey
*Assistant Examiner*—Patrick Cicchino
(74) *Attorney, Agent, or Firm*—Squire, Sanders & Dempsey L.L.P.

(57) ABSTRACT

A sheet transfer direction changing apparatus having a plurality of discharge sections, a direction changing device, discharge sheet transfer device and transfer device wherein a sheet transferred from an image forming apparatus is changed by its direction, obverse side and reverse side, and transfer direction according to a process command from the image forming apparatus and transferred to the discharged section.

16 Claims, 7 Drawing Sheets

SHEET TRANSFER DIRECTION CHANGING APPARATUS

BACKGROUND OF THE INVENTION

The present invention relates to a sheet transfer direction changing apparatus.

There is provided an image forming system wherein an image forming apparatus is equipped with a post-processing apparatus selectively desired in a plurality of post-processing apparatuses which carry out post-processing for a sheet on which an image is formed through an image forming apparatus.

In a conventional image forming apparatus system, an image forming apparatus and a plurality of post-processing apparatuses which are connected with the image forming apparatus are arranged in a practically straight line in a direction of sheet transfer direction. (for example Patent Document 1).

In recent years, besides diversification of post-processing function, cases where various systems are arranged combining functional post-processing apparatuses are considerable.

Patent Document 1: Japanese Unexamined Patent Application Open to Public Inspection No. 2003-155160

However, in the system based on a single image forming apparatus, there some functions which are difficult to be compatible due to various restrictions. With conventional system, though multi-functionalizing and compatibleness of functions were able to be realized by increasing the number of connections of apparatuses in a the same practically straight line, there have actually occurred problems such as needlessly prolonged sheet transfer distance and difficulty of maintaining reliability of electric connection between the connected apparatuses. Further, since the change of sheet direction was carried out in the post-processing apparatus according to the processes in the post-processing apparatus, in case a plurality of post-processing apparatuses are connected, the sheet direction changing function was needed to in each post-processing apparatus, resulting in a large system and high cost.

An object of the present invention is capable of providing a low cost image forming system wherein the sheet transfer path can be shorten even if a plurality of various post-processing apparatuses are connected based on a single image processing apparatus and highly reliable electric connection between apparatuses can be maintained.

SUMMARY OF THE INVENTION

An objective of the present invention can be accomplished by each of the following:

A sheet transfer direction changing apparatus to be connected to an image forming apparatus, having: a sheet feeding section to carry in a sheet discharged from an discharge section of the image forming apparatus; a plurality of discharge sections from which the sheet transferred from discharge sheet transfer device is discharged; a direction changing device to change a sheet direction form a direction when the sheet is fed from the image forming apparatus; a discharge sheet transfer device to transfer the sheet whose direction is changed to one of a plurality of discharge sections; a transfer device to transfer the sheet whose direction is changed to the discharge sheet transfer device; and a control device controls changes of sheet directions and sheet transfer directions, wherein a post-process apparatus can be connected with one of a plurality of discharge sections which are in a different direction from a direction of the sheet discharged from the image forming apparatus.

DESCRIPTION OF THE PREFERRED EMBODIMENT

The following is a description of the preferred embodiments of this invention with reference to the drawings.

Figure 1:
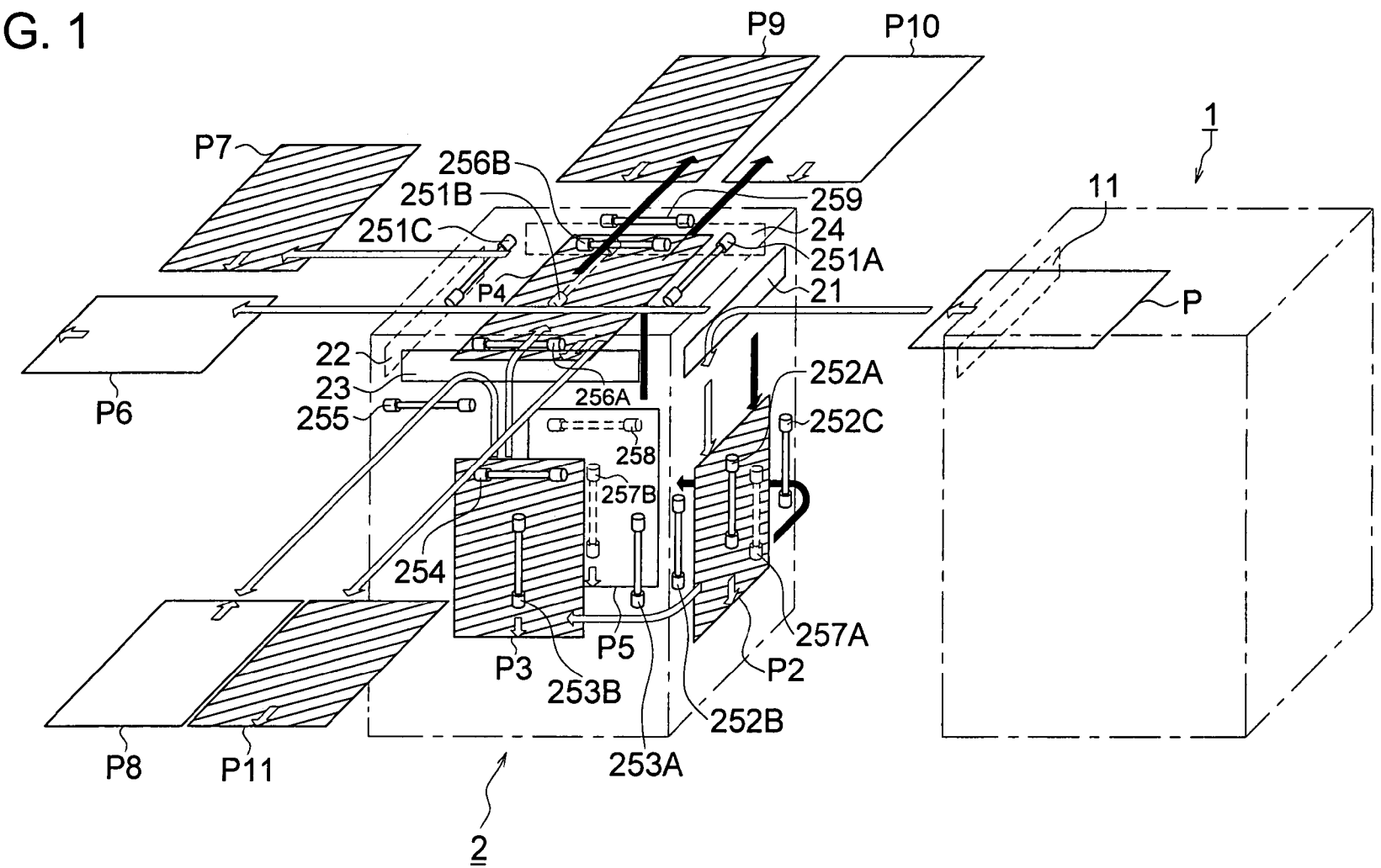
FIG. 1 is a schematic drawing showing a configuration of a sheet transfer direction changing apparatus of the present invention which is connected to an image forming apparatus.

FIG. 1 schematically shows a configuration of sheet transfer direction changing apparatus 2 of the present invention connected to image forming apparatus 1.

The image forming apparatus 1 forms an image on sheet P and discharge sheet P from discharge section 11. In the FIG. 1, a surface having hatching is reverse surface and a blank surface is an obverse surface. The arrow on the sheet directs front end so as to indicate the sheet direction. Here, to judge whether sheet direction is changed or not, an image formed on the sheet discharged from image forming apparatus 1 is a base of the judgment, which means that it is judged from whether the obverse and reverse surfaces or longitudinal and lateral sides of the sheet have been changed or not. For example, in FIG. 1, in a relation between sheet P and sheet P6, the direction of the sheet is not changed because the blank surface is up and the sheet is discharged longitudinally in the same direction. Thus the direction of the sheet is not changed. Sheet direction of P2 to P5 and P7 to P11, is changed in respect to sheet P2.

Sheet transfer direction changing apparatus 2 is composed of sheet feeding section 21, direction changing device to change the direction of sheet P (FIG. 2, numeral 25) and discharge sheet transfer device (FIG. 2, numeral 26) capable of discharging sheet P carried in from sheet feeding section 21 straight, first, second and third discharge section 22, 23 and 24 where after processing, sheet P is transferred to a post-processing apparatus connected to sheet transfer direction changing apparatus 2.

Figure 2:
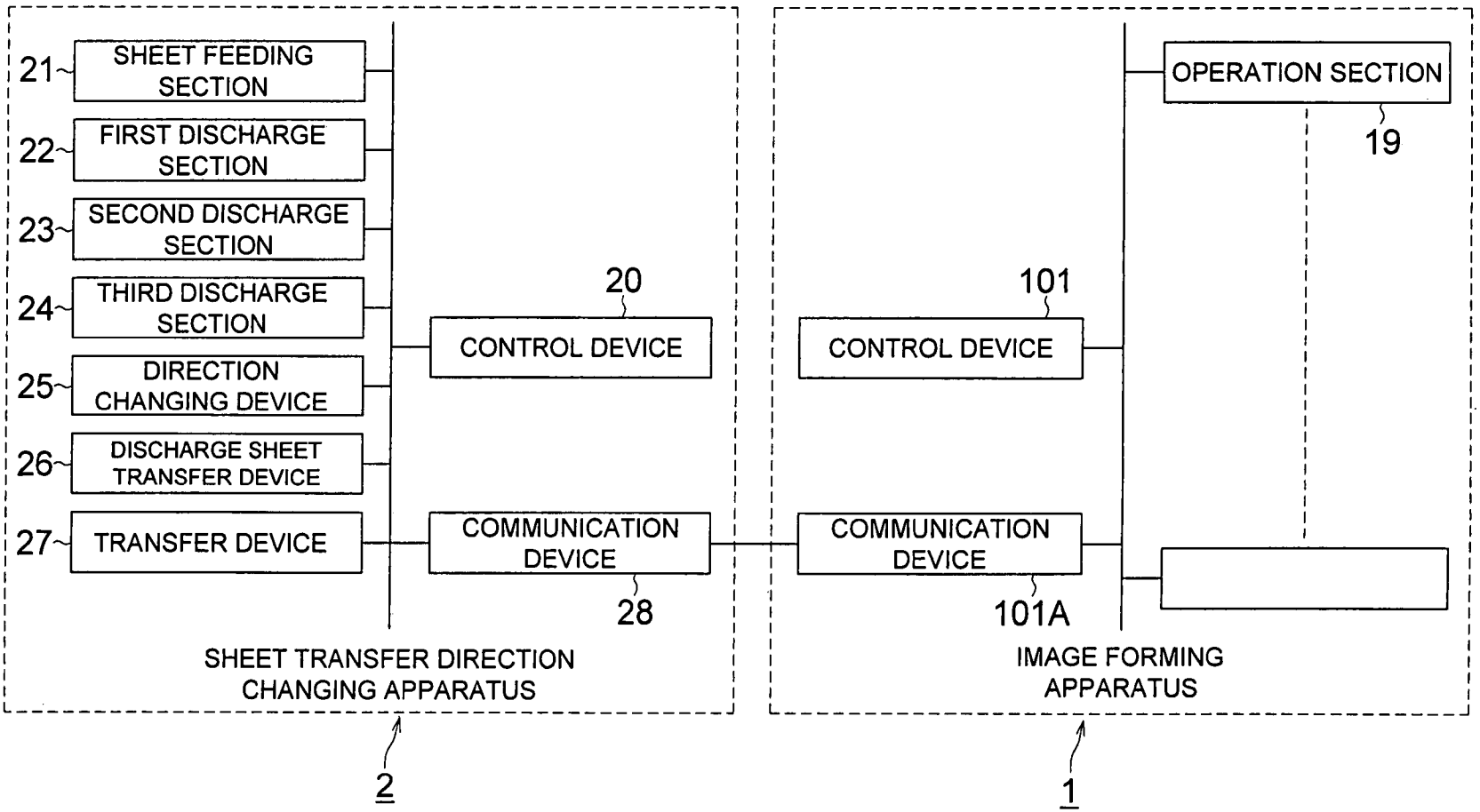
FIG. 2 is a block diagram of a sheet transfer direction changing apparatus of the present invention which is connected to an image forming apparatus.

FIG. 2 is a block diagram of sheet transfer direction changing apparatus 2 of the present invention connected to image forming apparatus 1.

Control device 20 is, for example, composed of a CPU, a RAM and a ROM. The CPU executes process program stored in the ROM using the RAM as a buffer memory.

In accordance with the aforesaid process program, this control device 20 controls each operation based on statuses such as operation conditions 21 of sheet feeding section, first discharge section 22, second discharge section 23, third discharge section 24, direction changing device 25, discharge sheet transfer device 26, transfer device 27 and communication section 28. Referring to FIG. 1 and FIG. 2, a flow of control is explained.

Control device 101 for image forming apparatus 1 send a post-process command to control device 20 of sheet transfer direction changing apparatus 2 via communication section 101A and communication section 28 of sheet transfer direction changing apparatus 2.

Control device 20 translates the received post-process command and selects the after-mentioned processing path of transferred sheet P.

Transferred sheet P is processed and transferred through rollers and paired rollers of direction changing device 25 and discharge sheet transfer device 26, transfer device 27, transfer path switching device 261 and 262.

Figure 3:
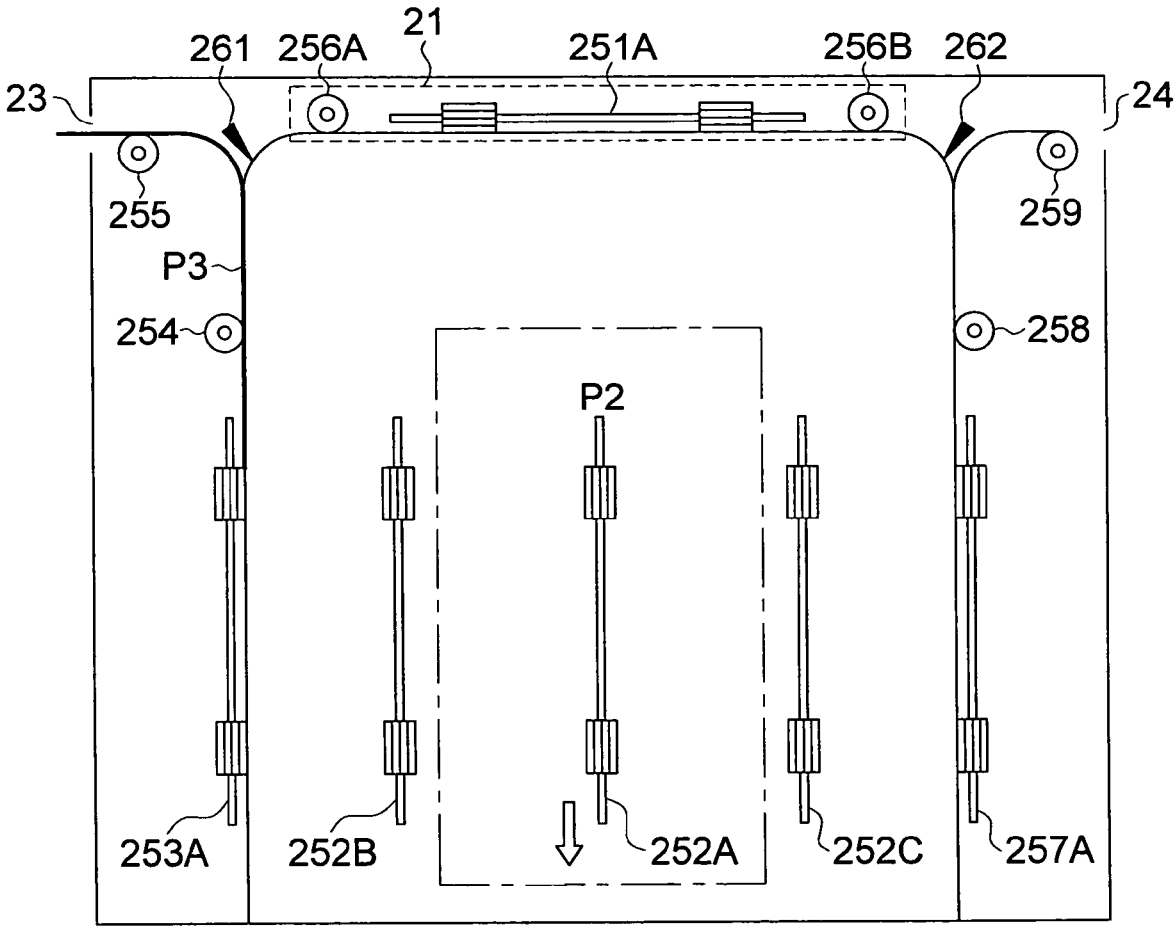
FIG. 3 is a side view of the sheet transfer direction changing apparatus when the right side panel is removed.

FIG. 3 is a side view of sheet transfer direction changing apparatus 2 in FIG. 1 wherein a right panel at which sheet feeding section 21 is located is removed.

While sheet feeding section 21 surrounded by broken lines is not shown in the figure when the right panel is removed, it is located at the broken line position on the right panel.

Referring to FIG. 1 and FIG. 3, a procedure to change the transfer direction of sheet P is explained.

<Processing Path 1>

Sheet P discharged from discharge section 11 of image forming apparatus 1 goes down approximately vertically from sheet feeding section 21 of sheet transfer direction changing apparatus 2 and is transferred to first discharge section 22 without changing its direction through paired roller 251A, 251B and a roller 251C representing the discharge sheet transfer device. In the processing path 1, sheet P is transferred to a post-processing apparatus without changing its direction after being printed by the image forming apparatus (the position of sheet P6).

<Processing Path 2>

Sheet P discharged from discharge section 11 of image forming apparatus 1 goes down approximately vertically from sheet feeding section 21 and stops once and then is stored at a position of sheet P2. At this sheet P2 position, a plurality of subsequent sheets P are piled up as needed. Sheet P is changed by its direction by paired rollers 252A and 252B, and paired rollers 253A and 253B the representing direction changing device, and the sheet P goes around to a position of sheet P3 which is in front of sheet transfer direction changing apparatus 2 in FIG. 1. Afterward, by switching transfer path switching device 261 (FIG. 3) to the direction opposite to the direction shown in FIG. 3, sheet P is pulled up through roller 254 representing the transfer device and transferred to a position of P4 through paired rollers 256A and 256B representing discharge sheet transfer device, then transferred to first discharge section 22 through paired rollers 251A, 251B and roller 251C representing discharge sheet transfer device. Sheet P is discharged upside down (the position of sheet P7).

<Processing Path 3>

Sheet P discharged from discharge section 11 of image forming apparatus 1 goes down approximately vertically from sheet feeding section 21 and stops once and then is stored at a position of sheet P2. At this sheet P2 position A, a plurality of subsequent sheets P are piled up as needed. Sheet P is changed its direction by pared rollers 252A and 252B, and paired rollers 253A and 253B representing direction changing device, and sheet P goes around to a position of sheet P3 which is in front of sheet transfer direction changing apparatus 2 in FIG. 1. Afterward, by switching transfer path switching device 261 (FIG. 3) to direction shown in FIG. 3, sheet P is pulled up through roller 254 representing transfer device and transferred to second discharge section 23 through roller 255 representing discharge sheet transfer device and discharged from second discharge section 23. In processing path 3, the sheet direction of sheet P is turned 90° and the sheet transfer direction of sheet P is turned 90° in anticlockwise direction (the position of sheet P8) versus the position of sheet P when it is fed from sheet feeding section 21.

<Processing Path 4>

Sheet P discharged from discharge section 11 of image forming apparatus 1 goes down approximately vertically from sheet feeding section 21 and stops once and then is stored at a position of sheet P2. At this sheet P2 position A, a plurality of subsequent sheets P are piled up as needed. Sheet P is changed by its direction by paired rollers 252A and 252B, and paired rollers 253A and 253B representing direction changing device, and sheet P goes around to a position of sheet P3 which is in front of sheet transfer direction changing apparatus 2 in FIG. 1. Afterward, by switching transfer path switching device 261 (FIG. 3) to the direction opposite to the direction shown in FIG. 3, sheet P is pulled up to the position of sheet P4 through roller 254 representing transfer device and transferred to third discharge section 24 through paired rollers 256A and 256B and roller 259 representing discharge sheet transfer device. In processing path 4, sheet P is reversed from the sheet P carried in from sheet feeding section 21, the sheet direction of sheet P is turned 90° and the sheet transfer direction of sheet P is turned 90° in clockwise direction (the position of sheet P9), versus the position of sheet P when it is fed from sheet feeding section 21.

<Processing Path 5>

Sheet P discharged from discharge section 11 of image forming apparatus 1 goes down approximately vertical from sheet feeding section 21 and stops once and then stored at a position of sheet P2. At this sheet P2 position, a plurality of subsequent sheets P are piled up as needed. Sheet P is changed by its direction by paired rollers 252A and 252B, and paired rollers 257A and 257B representing direction changing device, and is transferred to a position of sheet P5 (vision through position) on the other side of sheet transfer direction changing apparatus 2. Afterward, by switching transfer path switching device 262 (FIG. 3) to the direction opposite to the direction shown in FIG. 3, as sheet P is pulled up through roller 258 representing transfer device, it is transferred to third discharge section 24 through roller 259 representing discharge sheet transfer device and then discharged from discharge section 24. Paired rollers 257*a* and 257B, and roller 258 are provided in the opposite side (the other side in FIG. 1) in the apparatus at positions corresponding to that of paired rollers 253A and 253B, and roller 254. In processing path 5, sheet P received from sheet feeding section 21 changed its sheet direction 90° and its sheet direction is changed 90° in clockwise direction from the direction when sheet P is fed from sheet feeding section 21 (the position of Sheet P10).

<Processing Path 6>

Sheet P discharged from discharge section 11 of image forming apparatus 1 goes down approximately vertically from sheet feeding section 21 and stops once and then is stored at a position of sheet P2. At this sheet P2 position, a plurality of subsequent sheets P are piled up as needed. Sheet P is changed by its direction through paired rollers 252A and 252B, and paired rollers 257A and 257B representing direction changing device, and is transferred to a position of sheet P5 (vision through position) on the other side of sheet transfer direction changing apparatus 2. Afterward, by switching transfer path switching device 262 (FIG. 3) to the direction opposite to the direction shown in FIG. 3, sheet P is pulled up through roller 258 representing the transfer device and transferred to second discharge section 23 through paired rollers 256A and 256B representing the discharge sheet transfer device. In processing path 6, sheet P received from sheet feeding section 21 is reversed, its sheet direction is changed 90° and the transfer direction is turned 90° in anticlockwise direction (the position of sheet P11). Meanwhile, besides the aforesaid embodiment, depending on the sequence of use of the rollers, the paired rollers and the transfer path changing devices, the sheet direction, the obverse side and the reverse side, and the transfer direction of sheet P can be changed.

Figure 4:
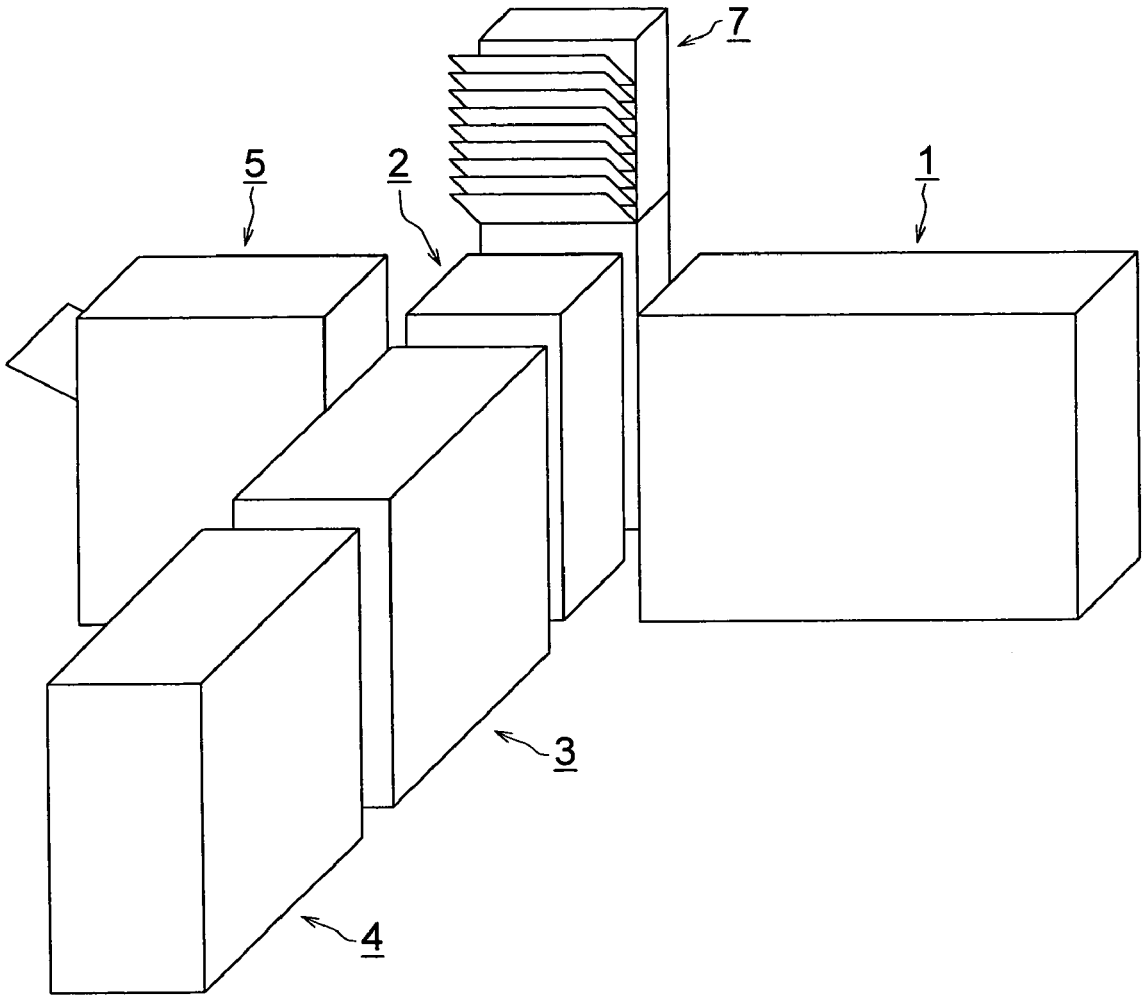
FIG. 4 is a schematic drawing of an example of an image forming system where the sheet transfer direction changing apparatus of the present invention and a plurality of post-processing apparatus are connected to an image forming apparatus.

FIG. 4 shows an example of image forming system, wherein a sheet transfer direction changing apparatus of the present invention and a plurality of post-processing apparatuses are connected to a single image forming apparatus.

The aforesaid image forming system is composed of image forming apparatus 1, sheet transfer direction changing apparatus 2, first sheet loading device 3, second sheet loading device 4, folding and biding apparatus 5 and mail bin 7.

Meanwhile, besides the image forming system in FIG. 4, a large number of configurations regarding type, number of units, sequence of connection and method of connection of post-processing apparatus can be considered.

[Image Forming Apparatus]

Figure 5:
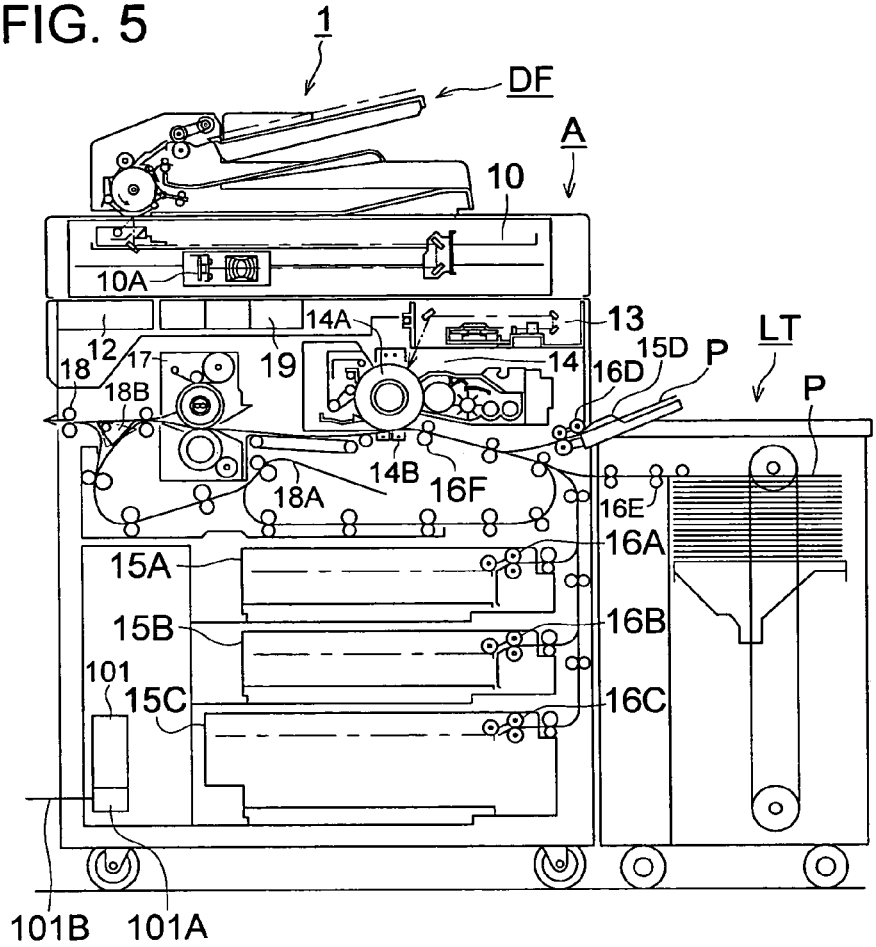
FIG. 5 is a total configuration view showing an example of an image forming apparatus.

FIG. 5 is a total structural diagram of image forming apparatus.

Image forming apparatus 1 is composed of image forming apparatus main body A, automatic document transfer device DF and large capacity sheet feeding apparatus LT.

Image forming apparatus main body A shown in the figure is provided with image scanning section 10, image processing section 12, image writing section 13, image forming section 14, sheet feeding cassettes 15A, 15B and 15C, manual sheet feeding tray 15D, first sheet feeding section 16A, 16B, 16C and 16D, second sheet feeding sections 16F, fixing device 17, sheet discharge section 18, and automatic two-sided copy sheet feeding section (ADU) 18A.

Unillustrated sheet transfer direction changing apparatus 2 is connected by sheet discharge section 18 which is on the left side of image forming apparatus main body A shown in the figure.

One side or both sides of a document placed on manuscript table installed on automatic document transfer device DF are scanned through optical system of image scanning section 10 and loaded through CCD image sensor 10A. A photoelectrically converted analogue signal is sent to image writing section 13 after processes such as analogue process, A/D conversion, shading correction and image compression in image processing section 12.

In image writing section 13, output beam is irradiated from semiconductor laser to photoconductive drum 14A of image forming section 14 to form a latent image. In image forming section 14, processes such as charging, exposure, development, transfer, separation and cleaning are carried out. On the sheet P fed from each of first feeding section 16A to 16C of sheet feeding cassette 15A to 15C, first sheet feeding section 16D of manual sheet feeding tray 15D and first sheet feeding section 16E of large capacity sheet feeding device LT through second sheet feeding section 16F, an image is transferred through transferring device 14B. Sheet P carrying the image is fixed by fixing device 17 and sent to sheet transfer direction changing apparatus 2 through sheet discharge section 18. Or, sheet P with anopisthographic image processing sent to automatic two sided copy sheet feeding section 18A through transfer path changing plate 18B is discharged from sheet discharge section 18 after image processing is done on both sides again in image forming section 14.

Operation section 19 selects and sets processing functions of image forming apparatus 1 and post-processing apparatus including sheet transfer direction changing apparatus 2.

Control device 101 is connected to the control device via communication section 101A and communication circuit 101B through communication section of post-processing apparatus.

[Sheet Transfer Direction Changing Apparatus]

The explanation regarding sheet transferring direction changing apparatus 2 is omitted as it is explained before.

[Sheet Loading Device]

Figure 6:
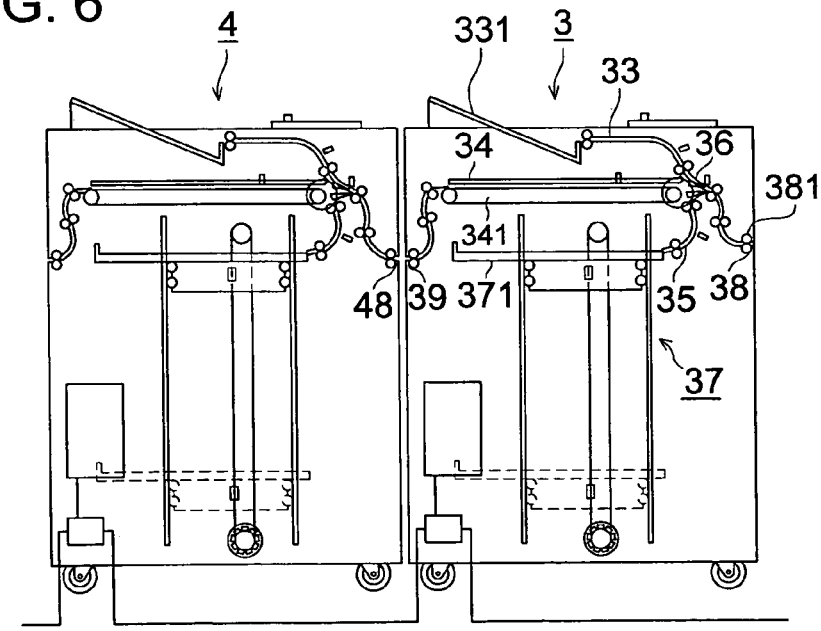
FIG. 6 is a structural drawing in which a plurality of sheet loading devices are connected.

The structure of first sheet loading device 3 is explained referring to FIG. 6. FIG. 6 is a configuration diagram where first sheet loading apparatus 3 and second sheet loading apparatus 4 are connected subsequently. Meanwhile, explanation structure of second sheet loading apparatus 4 is omitted as the configuration thereof is the same as first sheet loading device 3.

First sheet loading device 3 is provided with receiving opening 38 and receiving roller 381 adjusting their height and position so that they can align with second discharge section 23.

The transferring path of sheet P connected to downstream side of receiving roller 381 in transferring direction is branched in 3 stemmas i.e. first discharging path 33, second discharging path 34 and loading path 35, and sheet P is fed to one of the transferring paths by switching device 36.

Also, an unillustrated outer panel which an operator faces of first sheet loading device 3 provides is provided with an unillustrated opening-closing door to be capable of loading and taking out the bunch of the sheets or to removing jammed sheets.

<Simple Discharge Mode>

Sheet P discharged to first discharge path 33 is transferred to discharge section 331 and discharged to be piled.

<Transit Mode>

Sheet P transferred to second discharge path 34 is loaded on belt conveyer 341 and transferred and then discharged from discharge port 39 towards receiving port 48 of second sheet loading device 4 located downstream.

<Loading Mode>

Sheet P transferred to loading path 35 is transferred to sheet loading section 37 representing a discharge sheet tray.

Stage 371 of sheet loading section 37 positions its top surface at a position which is slightly lower than sheet discharge position of loading path 35 by a thickness of sheet P. In this way, as a plurality of sheet P are piled on stage 371, stage 371 is lowered at a distance equivalent to the total thickness of a plurality of sheet P and the top of stage 371 is positioned so that a sheet P on the top position becomes slightly lower than loading path 35.

[Folding and Binding Processing Apparatus]

Figure 7:
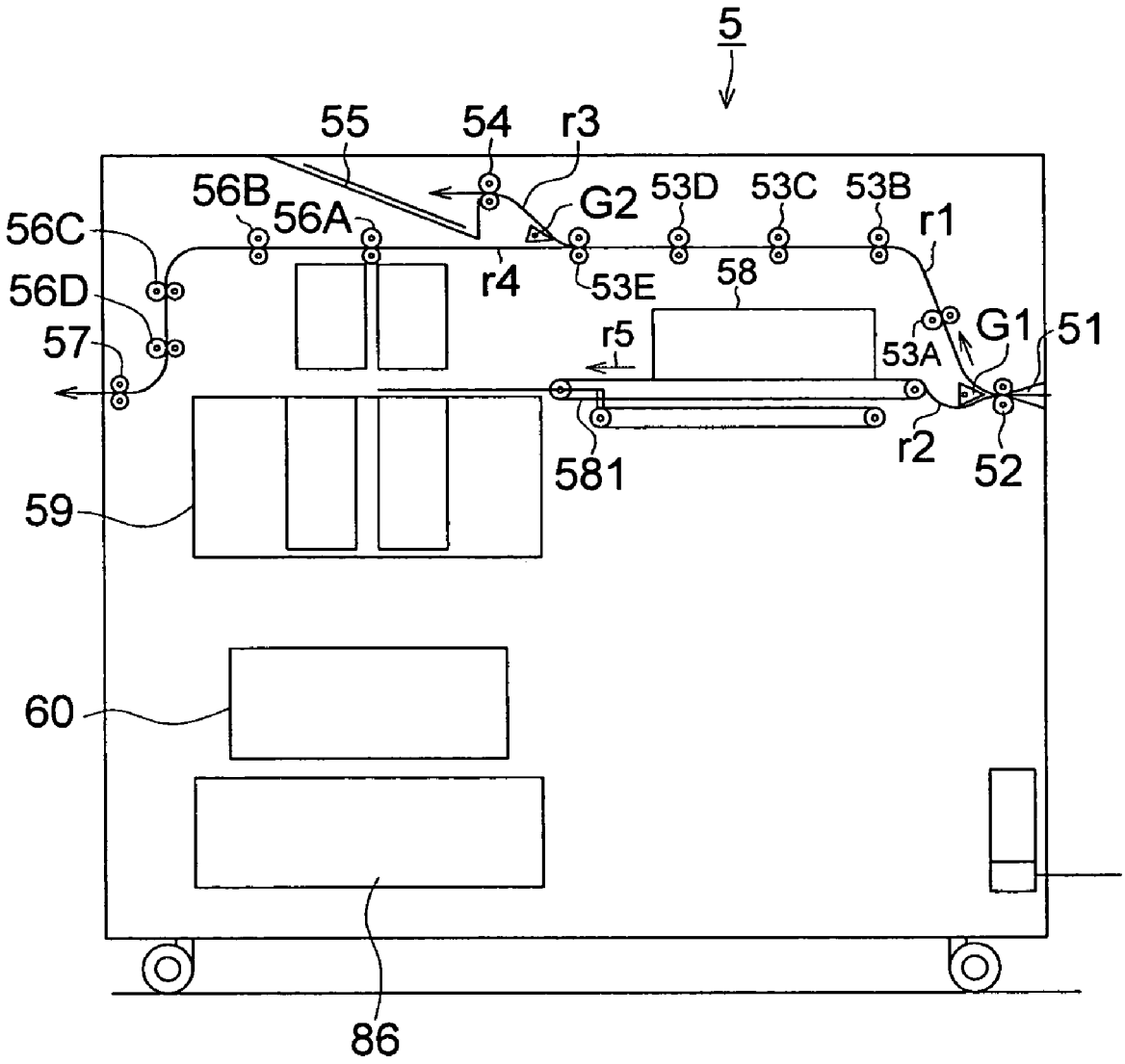
FIG. 7 is a schematic drawing of sheet transfer to center folding and center binding process flow in folding and binding process apparatus.

FIG. 7 is schematic diagram where sheet transfer to center folding and binding process of folding and binding processing apparatus 5 is shown.

As shown in FIG. 7, sheet p discharged from sheet transfer direction changing apparatus 2 is introduced to entrance section 51 of folding and binding process apparatus 5, then it is interposed by entrance roller 52 to be transferred to sheet transfer path r1 above transfer path switching device G1 or sheet transfer path r2 below transfer path switching device G1.

<Transit Mode>

Sheet P introduced to sheet transfer path r1 is interposed by transfer rollers 53A to 53E and transferred to sheet transfer path r3 above transfer path switching device G2 or sheet transfer path r4 below transfer path switching device G2.

Sheet P advanced to sheet transfer path r3 located above is discharged through sheet discharge roller 54 and loaded on sub-discharge sheet tray 55 located at upper part of folding and binding processing apparatus 5.

Sheet P processed through sheet transfer path r4 located below is nipped through transfer rollers 56A to 56D to be transferred and discharged through sheet discharge roller 57. The discharged sheet may be received by an unillustrated discharge tray or further, may be carried in to a post-processing apparatus connected to folding and binding processing apparatus 5.

<Center Folding Process>

For a piece or a plurality of pieces of sheet P reached folding device 58, center folding process is carried out to form a quire in which a folding line is formed in the center in sheet transfer direction across the sheet width. The quire is transferred to sheet transfer path r5 located in a direction where the folding line is extended by transfer device 581 and sent to center binding device 59.

In this way, folding device 58 carries out center folding process for a small number of sheets P from 1 to 3 pieces to make folding line firmly and sends them to center binding device 59, thereby a solid bunch of sheet can be made.

<Center Binding Process>

A bunch of sheet which is subjected to center folding processed in folding device 581 is advanced to sheet transfer path r5 in the direction of an arrow by transfer device 581 and loaded on an unillustrated saddle piling device of center binding device 59. The subsequent bunch of quire sheet which is center-folding-processed continuously passes through sheet transfer path r5 and is piled on saddle piling device. The bunch of sheet loaded on the saddle piling device are stapled at two symmetrical points.

<Cutting Device>

Cutting device 60 cuts outer margin of stapled bunches of sheets.

<Discharging Booklet>

The bunch of sheet (booklet) after cutting process is transferred to discharge tray 86 by an unillustrated transfer belt.

[Mail Bin]

Figure 8:
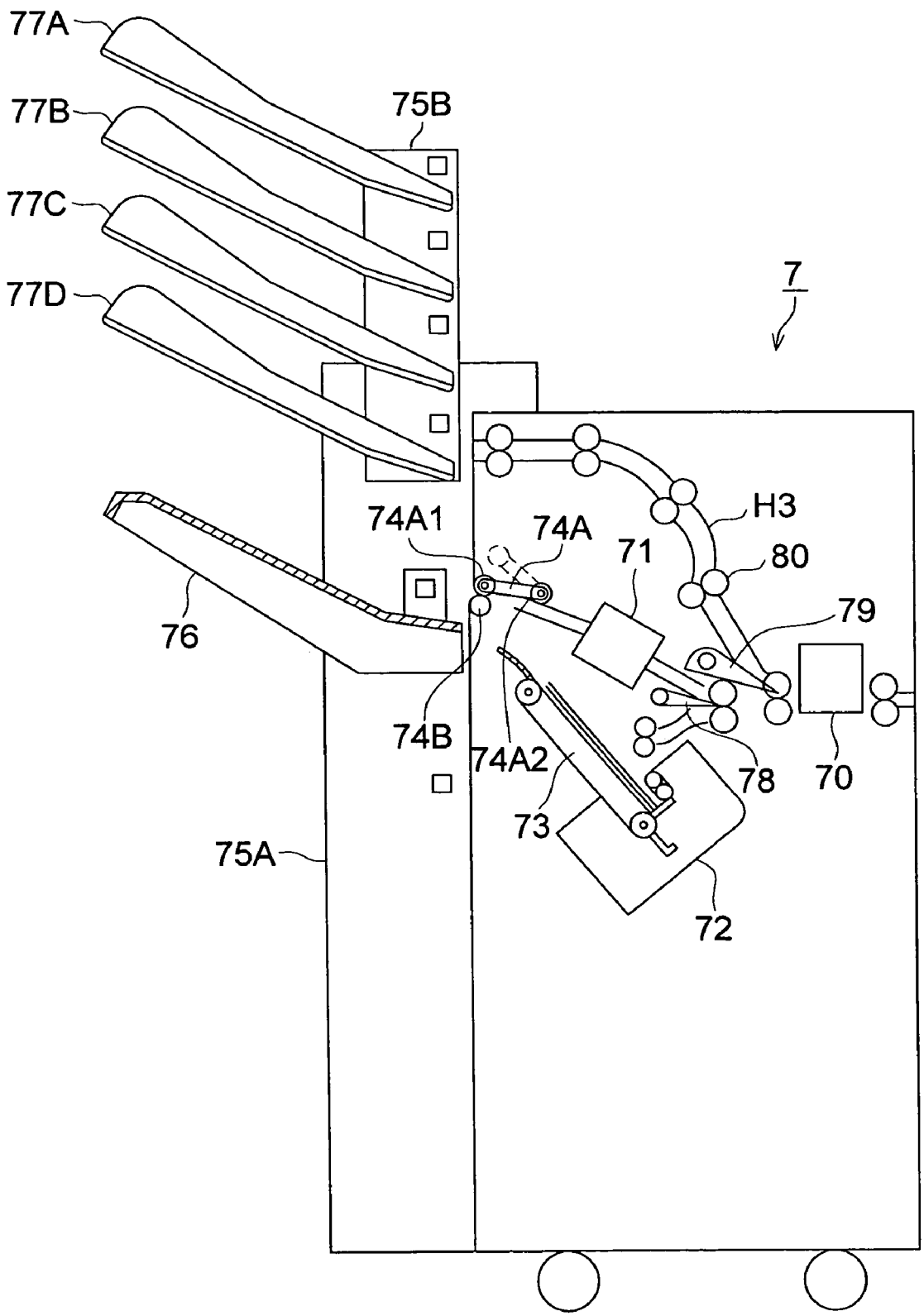
FIG. 8 is a total configuration view of an example of mail bin.

FIG. 8 is a total structural diagram showing an example of mail bin.

Mail bin 7 has punching apparatus 70 to make holes on sheet P at predetermined positions, shift processing apparatus 71 to discharge the sheet after shifting sheet position in the direction perpendicular to sheet discharge direction and binding processing apparatus 72 to bind sheet P at its predetermined position, and after process through these processing apparatuses 70 to 72, through transfer roller 80 and switching guide section 78, sheet P is discharged from a sheet discharge port configured by rollers 7A and 74B or though discharge path H3.

Numeral 73 represents an intermediate stacker. In intermediate stacker 73, sheet P whose number of pieces are set in each image forming job are piled, adjusted and biding processed through biding processing apparatus 72.

Discharge roller 74A is configured by a pair of rollers 74A1 and 74A2 which are connected by a belt, and roller 74A2 is capable of shifting up and down as shown in FIG. 8, and it shifts up and down depending on the thickness of the paper that pass through the roller 74A2. Discharge roller 74B is a drive roller and discharges the sheet transferred from shift device 71 or intermediate stacker 73.

Fixed support frame 75A supports elevating support frame 75B and sheet discharge tray 76.

Elevating support frame 75B is provided with 4 mail bins 77A to 77D to construct a mail bin apparatus. As mentioned above, elevating support frame 75B and sheet discharge tray 76 can shift up and down, and sheet discharge tray 76 and mail bins 77A to 77D are respectively able to be set at positions where sheet P is discharged from sheet discharge port which is provided with discharge roller 74A and 74B.

Meanwhile, mail bin apparatus wherein each mail bin can shift individually and independently can be used as a mail bin apparatus.

As explained above, in the past, an image forming apparatus and a post-processing apparatus were connected in almost the same straight line to execute a sequence of process as a system. However, by allocating apparatuses in a shape of a cross having the embodiment of the present invention in the center, the aforesaid effects can be expected and allocation of post-processing apparatus can have greater flexibility.

What is claimed is:

1. A sheet transfer direction changing apparatus to be connected to an image forming apparatus, comprising:

a plurality of discharge sections, orientated in three different discharge directions in a top view of the sheet transfer direction changing apparatus in a plane substantially, to discharge the sheet in one of three directions which are deviated 90 degrees, 180 degrees and 270 degrees from a transfer direction of the sheet discharged from the image forming apparatus;

a sheet feeding section to carry in a sheet discharged from a discharge section of the image forming apparatus;

a direction changing device to change a sheet direction, from a sheet direction when the sheet is originally fed from the image forming apparatus, wherein the sheet fed from the sheet feeding section is stored and held in a vertical state once then turned 90 degrees clockwise direction or anticlockwise direction in a top view of the sheet transfer direction changing apparatus;

a discharge sheet transfer device to horizontally transfer the sheet transferred from the direction changing device in which the sheet is held in a vertical state to one of the discharging sections, while changing sheet transfer directions from a sheet transfer direction when the sheet is originally fed from the image forming apparatus, wherein the sheets are transferred in one of a face-up and in a face-down state respectively in each of the sheet transfer directions, at least in a state that the sheet direction is turned substantially 90 degrees clockwise direction, anticlockwise direction and not turned in respect to the sheet direction when the sheet has been originally fed from the image forming apparatus; and a control device to control the direction changing device and the discharge sheet transfer device, wherein a post-process apparatus can be connected with one of the plurality of the discharge sections which are in a different transfer direction from the transfer direction of the sheet discharged from the image forming apparatus.

2. A sheet transfer direction changing apparatus of claim 1, wherein the control device controls the direction changing device so as to turn over the sheet while the sheet is transferred.

3. A sheet transfer direction changing apparatus of claim 1, wherein the plurality of the discharge sections are positioned so as to discharge the sheet in substantially the same height.

4. A sheet transfer direction changing apparatus of claim 1, wherein the sheet feeding section is positioned at approximately the same height as that of the plurality of the discharge sections.

5. A sheet transfer direction changing apparatus of claim 1, wherein a plurality of subsequent sheets are stored in the direction changing device.

6. A sheet transfer direction changing apparatus of claim 1, wherein the control device controls a transfer path switching device to switch transfer paths through which the sheet transferred from the direction changing device passes, so that the sheet transferred from the direction changing device is discharged face up or down from one of the plurality of the discharge sections.

7. A sheet transfer direction changing apparatus of claim 1, wherein the control device receives a post-process command sent from a communication section of the image forming apparatus through a communication section.

8. A sheet transfer direction changing apparatus of claim 1, wherein the control device controls changes of the sheet directions and the sheet transfer directions according to a post-process command sent from a communication section of the image forming apparatus through a communication section.

9. A sheet transfer direction changing apparatus of claim 1, wherein the direction changing device is composed of rollers.

10. A sheet transfer direction changing apparatus of claim 1, wherein the discharge sheet transfer device is composed of rollers.

11. A sheet transfer direction changing apparatus of claim 1, wherein the discharge sheet transfer device is composed of rollers that rotate reversibly.

12. A sheet transfer direction changing apparatus of claim 1, wherein the sheet discharged from the discharge section of the image forming apparatus is transferred through the sheet feeding section to the discharging sheet transfer device directly and transferred to one of the plurality of the discharge sections maintaining the sheet direction when the sheet is discharged from the discharge section of the image forming apparatus.

13. A sheet transfer direction changing apparatus of claim 1, wherein the control device controls the sheet to turn 90 degrees in a clockwise direction or anticlockwise direction at the direction changing device, based on the sheet direction or sheet transfer direction desired at one of the plurality of discharge section.

14. A sheet transfer direction changing apparatus of claim 1, wherein the control device controls the direction changing device so that the sheet direction is changed to be perpendicular to the sheet direction when the sheet is originally fed from the image forming apparatus.

15. A sheet transfer direction changing apparatus of claim 1, wherein the control device controls the discharge sheet transfer device so that the sheet transfer direction is changed to be perpendicular to the sheet transfer direction when the sheet is originally fed from the image forming apparatus.

16. A sheet transfer direction changing apparatus of claim 1, wherein the plurality of discharge section is positioned so as to discharge the sheet in the direction perpendicular to each other.

* * * * *